US006941927B2

(12) United States Patent
Almkvist et al.

(10) Patent No.: US 6,941,927 B2
(45) Date of Patent: Sep. 13, 2005

(54) INTERNAL COMBUSTION ENGINE CONTROL DURING COLD START

(75) Inventors: Goran Almkvist, Lerum (SE); Klaas Burgdorf, Ljungskile (DE); Lars Mikael Fredriksson, Kärna (SE)

(73) Assignee: Ford Global Technologies, LLC, Dearborn, MI (US)

( * ) Notice: Subject to any disclaimer, the term of this patent is extended or adjusted under 35 U.S.C. 154(b) by 184 days.

(21) Appl. No.: 10/445,613

(22) Filed: May 28, 2003

(65) Prior Publication Data

US 2004/0025836 A1 Feb. 12, 2004

(30) Foreign Application Priority Data

May 28, 2002 (EP) ..... 02445067

(51) Int. Cl.[7] ..... F02D 41/06
(52) U.S. Cl. ..... 123/339.14; 123/491
(58) Field of Search ..... 123/339.14, 339.12, 123/680, 685, 491; 701/103, 113

(56) References Cited

U.S. PATENT DOCUMENTS 5,188,082 A 2/1993 Udo et al.
5,579,737 A 12/1996 Tomisawa
5,715,796 A 2/1998 Suzuki et al.
5,954,025 A 9/1999 Kanamaru et al.
6,098,605 A 8/2000 Brooks
6,637,413 B2 * 10/2003 Maloney et al. ..... 123/491
6,672,284 B2 * 1/2004 Majima ..... 123/436
2002/0043247 A1 4/2002 Majima

FOREIGN PATENT DOCUMENTS

DE 19740699 3/1999
EP 0894964 2/1999

* cited by examiner

*Primary Examiner*—Hai Huynh
(74) *Attorney, Agent, or Firm*—Diana D. Brehob

(57) ABSTRACT

The invention relates to a method for controlling an internal combustion engine during a cold start operation. The engine is supplied with a substantially constant, lean air/fuel ratio immediately after the engine is started, while the engine has an idle speed that is allowed to vary as a function of the difference between a target air/fuel ratio and an actual air/fuel ratio. The invention further relates to an arrangement for carrying out the method.

14 Claims, 3 Drawing Sheets

INTERNAL COMBUSTION ENGINE CONTROL DURING COLD START

TECHNICAL FIELD

The invention relates to a method and an arrangement for controlling the idle speed of a combustion engine. The invention allows the idle speed to vary as a function of the air/fuel ratio immediately after the engine is started.

BACKGROUND OF THE INVENTION

It is well known that variation in the gasoline volatility can cause major problems with respect to drivability in cold start calibration, when trying to achieve low exhaust emissions. Using a lean start strategy usually causes the problem to increase.

The standard way to solve the problem is to enrich the air/fuel ratio to the extent that most variations in volatility lie within the drivability limits. Such air/fuel ratios will have a rich air factor $\lambda$ in the range of 0.7–0.9. By definition, an air factor, $\lambda$, less than 1 is termed "rich", while a value greater than 1 is termed "lean". The air factor is defined as the quantity of intake air divided by the theoretical air requirement, where the ideal stoichiometric air/fuel ratio (14.5 parts air and 1 part fuel) has an air factor of $\lambda=1$. The idle speed is conventionally controlled by adjusting the throttle and/or the ignition timing.

Using this rich setting will result in a significant increase in hydrocarbon (HC) and carbon monoxide (CO) in the engine out emission during the critical warm-up phase before the catalyst has reached its operating, or "light-off" temperature. FIG. 1 shows how HC emission increases with a reduction in the air factor, $\lambda$.

If the idle speed is set too high in a conventional combustion engine the fuel consumption, and consequently the exhaust emissions, will increase. The driver might also react to the increased noise from the engine. For vehicles with an automatic transmission it causes a noticeable jerking initial movement when the first or reverse gear engages.

If, on the other hand, idle speed is set too low, drivability is affected. Even a small fluctuation in engine stability may cause the engine to misfire, or to stall. The reduced amount of fuel will also increase the time taken for the engine to heat up, which directly affects the time required for the catalytic converter to reach its operating, or "light-off," temperature.

As a compromise, the engine idle speed is commonly locked to a predetermined value, which a central processing unit (CPU) is mapped to maintain at all times. With the air factor $\lambda$ set at "rich", as described above, the CPU uses the throttle and/or the ignition timing to maintain the required idle speed. This rich setting of the engine overcomes problems related to fuel volatility, but precludes a lean start strategy.

U.S. Pat. No. 5,954,025 (TOYOTA) discloses a vehicle with a dual fuel system having a stability detector. This arrangement determines that instability occurs when the engine speed drops below a reference speed, whereby the air/fuel ratio is adjusted. The invention allows variations of the idle speed caused by varying fuel volatility during normal operation, but is not suitable for use with a lean start strategy.

The standard solutions and the above prior art document describe various arrangements for managing engine idle speed, but do not solve the problem of engine emission sensitivity caused by variations in fuel volatility and required torque during a lean cold start, using an air factor $\lambda>1$. This problem is solved by the invention as described below.

SUMMARY OF THE INVENTION

The invention relates to a method and an arrangement for controlling the idle speed of a combustion engine. The invention allows the idle speed to vary as a function of the difference between a target and an actual air/fuel ratio immediately after the engine is started. According to a preferred embodiment of the invention, the method involves the control of an internal combustion engine during a cold start operation, whereby the engine is operated using a lean actual air/fuel ratio when the engine is started, and that the engine has an idle speed that is allowed to vary as a function of the difference between a target air/fuel ratio and the actual air/fuel ratio. In this case, the target air/fuel ratio is that of the air-fuel mixture in the intake conduit, while the actual air/fuel ratio is that of the air-fuel mixture in the combustion chamber. The difference between a target and an actual air/fuel ratio may, for instance, be caused by variations in the fuel properties and/or wetting of the walls of the intake conduit. During the cold start operation, the throttle is kept at a substantially fixed opening angle while the fuel supply is adjusted towards a predetermined lean actual air/fuel ratio, with an actual air factor $\lambda_T$ between $1.02<\lambda_T<1.2$. This air/fuel ratio is maintained at a substantially constant value while the idle speed is allowed to vary. By using a substantially constant flow of induction air corresponding to the torque required to overcome the instantaneous internal friction of the engine, the idle speed of the engine will vary accordingly. This is due to the fact that the oxygen content of the induction air determines the possible maximum supply of energy, that is the amount of fuel that is theoretically possible to burn per combustion cycle of the engine. This operation can be carried out using a substantially constant throttle angle. When a fuel giving a leaner air-fuel mixture such as a low volatile fuel is used, the idle speed is allowed to drop. This reduces the internal friction at the same time as the flow rate of induction air per stroke increases briefly, due to the increased intake pressure caused by the drop in engine speed, giving a higher torque output. The engine will subsequently stabilize at a lower idle speed with a maintained, substantially constant actual air/fuel ratio.

The operation can be further controlled by a basic calibration of the air-fuel mixture, performed to give a nominal idle speed. This calibration causes the air/fuel ratio to be enriched when a reduction in idle speed is detected, and the ratio to be made leaner when an increase in idle speed is detected. However, the purpose of the invention is to keep the actual air factor within a lean combustible range of $1.0<\lambda_A<1.5$, preferably within $1.02<\lambda_A<1.2$ during cold start idling. Preferably the air/fuel ratio is maintained at a substantially constant value within said range, which value is determined by the cold start strategy used for each particular engine. Using this calibration the engine will run at a slightly lower idle speed, but with substantially the same air/fuel ratio, when a low volatile fuel is used. The opposite process will of course be performed if fuel volatility is increased, or returns to its original value, thereby increasing the idle speed with a maintained value of actual air/fuel ratio. The calibration is performed using a mapping stored in a central processing unit (CPU) and will automatically correct the idle speed when changes in fuel volatility occur, or compensate for intermittent fluctuations in the idle speed.

Consequently, by calibrating the target fuel supplied to the induction air as a function of the engine speed, the actual air/fuel ratio supplied to the engine can be kept rather constant while the idle speed of the engine may vary, making the engine less susceptible to different fuel qualities. With this method it is possible to optimise the nominal air/fuel ratio for low emission with much less margins towards a rich air/fuel mixture. FIG. 2 shows a diagram in which the air factor λ has been plotted as a function of engine speed, whereby the slope of the curve is used to determine the amount of the target fuel to be supplied.

The above method can be applied to any internal combustion engine provided with an air intake inlet arrangement to supply induction air to at least one combustion chamber, at least one fuel injector to supply fuel to the induction air, an outlet for exhaust gas downstream of the engine, and a central processing unit for controlling the operation of said engine. The method is independent of the type of fuel supply and can be applied to engines using carburettors, port injection or direct injection.

BRIEF DESCRIPTION OF THE DRAWINGS

In the following text, the invention will be described in detail with reference to the attached figures. These figures are used for illustration only and do not in any way limit the scope of the invention. In the drawings.

DETAILED DESCRIPTION

Figure 1:
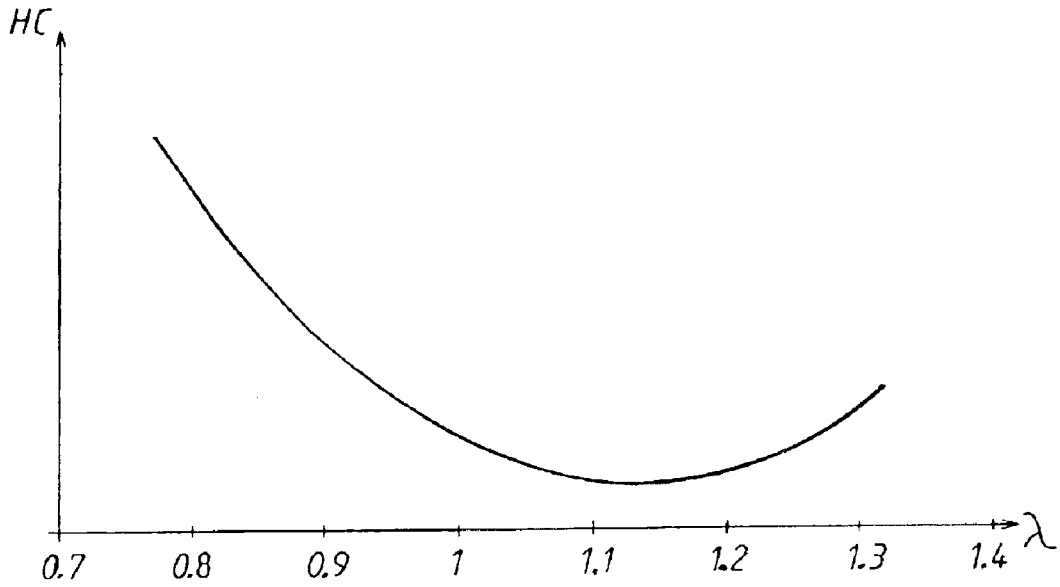
FIG. 1 shows a diagram in which hydrocarbon emission has been plotted as a function the air factor, λ.
Figure 2:
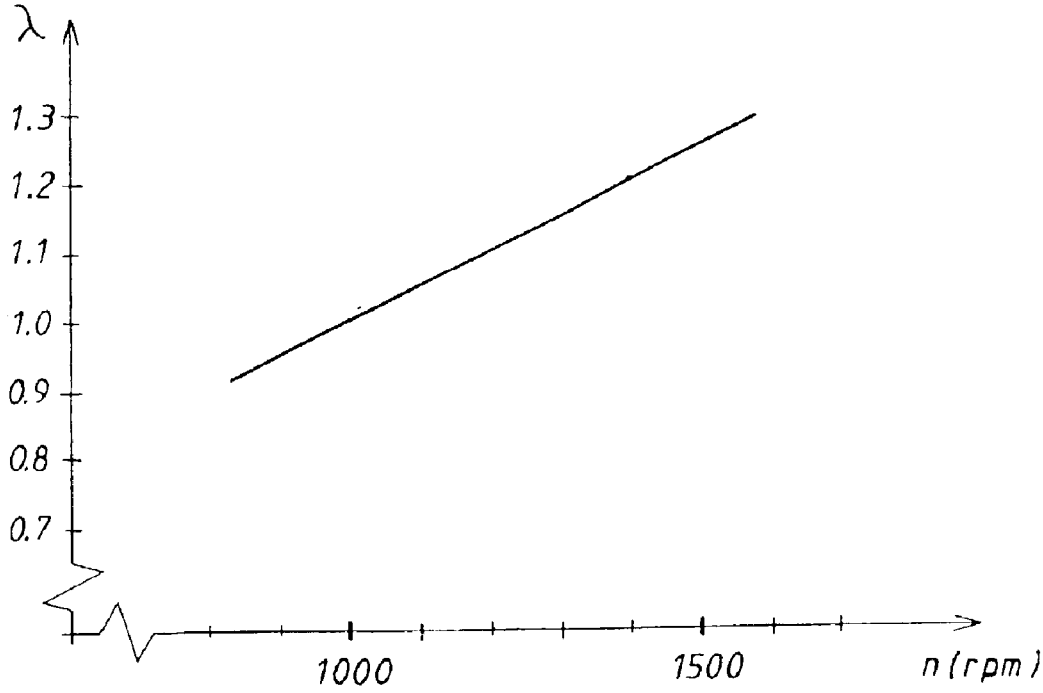
FIG. 2 shows a diagram in which the air factor, λ, has been plotted as a function of engine speed.
Figure 3:
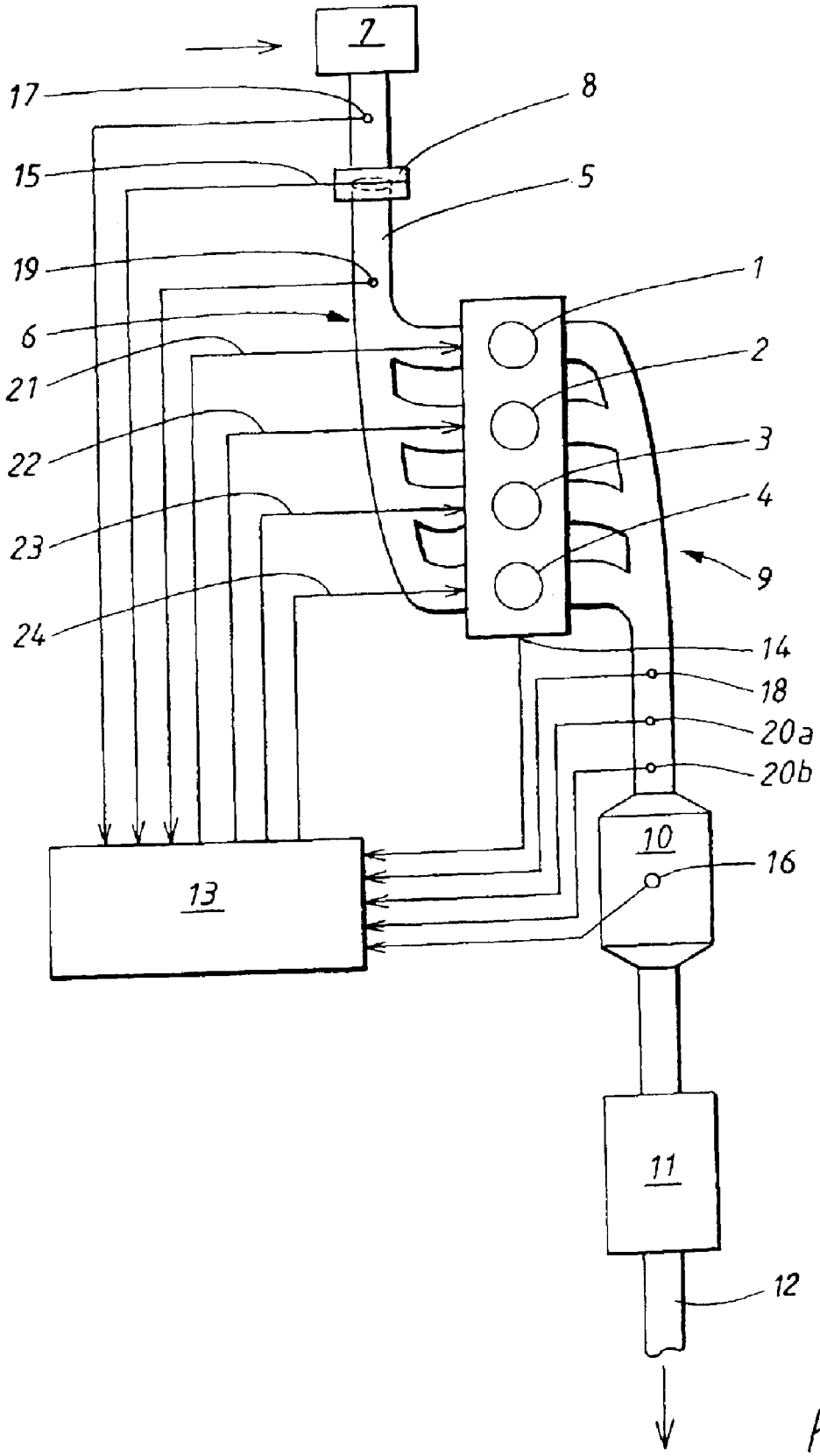
FIG. 3 shows a schematic diagram illustrating an internal combustion engine.

FIG. 3 shows a schematic diagram illustrating an internal combustion engine. The engine includes at least one cylinder 1–4 containing a reciprocating piston within a combustion chamber, which piston is connected to an output crankshaft. The engine has an intake system including an intake conduit 5 and an intake manifold 6 connecting the combustion chamber to a source of ambient air. The intake system includes an injector for supplying controlled amounts of fuel from a suitable fuel supply system to each cylinder. The intake system is arranged to receive air from an air cleaner 7 and supply the air to the intake manifold 6, where the air and fuel is mixed and supplied to the combustion chamber in the form of a combustible air-fuel mixture. The intake conduit 5 is further supplied with a throttle valve 8 that can be opened and closed for controlling the flow of air to the combustion chamber. The combustion chamber is provided with an intake valve and an exhaust valve (not shown) arranged to admit an air-fuel mixture and exhaust the combusted residual gases according to a conventional 4-stroke cycle.

Although only one intake and exhaust valve is described, it is of course possible to use more than one intake and exhaust valve. Depending on the type of engine and control system used, it may also be possible to operate the engine using a 2-, 6- or 8-stroke cycle.

The engine is also provided with an exhaust system including an exhaust manifold 9 ducted to the combustion chamber. From the combustion chamber the exhaust gases are conventionally ducted to a conventional exhaust system including a catalytic converter 10, a muffler arrangement 11 and a tailpipe 12.

The engine is controlled by a central processing unit (CPU) 13 that receives a number of input signals from various conventional sensors. The engine is provided with a speed sensor 14 for measuring the revolutions of the engine at the end of the crankshaft. The torque output can be determined either by using the output signal from said speed sensor, or by the airflow and the ignition timing. In the latter case, the ignition timing is determined by the CPU 13 and the air mass flow can be determined from the throttle setting or a separate air mass sensor (not shown). The throttle 8 is provided with a sensor 15 that measures the degree of opening, or throttle angle, to determine the mass flow of air supplied to the engine.

The converter 10 is provided with a temperature sensor 16 to determine when the light-off, or operating temperature is reached.

Additional sensors may include a number of temperature sensors, used for measuring ambient (intake) air temperature 17, exhaust gas temperature 18, and an engine coolant temperature. Pressure sensors 19 are used to measure intake air pressure and, when appropriate, the boost pressure from a turbocharger. One or more sensors may be provided for specific emissions in the exhaust, such as a sensor 20*a* for nitrous oxides (NOx). A further sensor, such as an oxygen sensor 20*b*, measures the composition of the exhaust gases to determine the air factor, λ, of the combustible air-fuel mixture.

During normal operation the signals from the sensors are transmitted to the CPU 13, which monitors the signals and uses a predetermined mapping of engine parameters to determine the operating status of the engine. By comparing the current values of a number of characteristic parameters with corresponding desired values for a particular operating condition, the CPU 13 transmits signals 21–24 to the respective fuel injectors and/or throttle 8 to correct the current values. The CPU can also control and adjust the ignition timing.

During a cold start of the engine, many of the above sensors are not operational immediately. In particular, sensors relating to exhaust emissions require a warm-up period before a reliable reading can be transmitted to the CPU 13. For this reason, the arrangement cannot rely on a number of sensors specifically directed to exhaust emissions immediately after the engine is started.

In operation, when the engine is started the CPU 13 transmits signals to the throttle 8 and the fuel injectors in accordance with a predetermined data mapping stored in the CPU 13. The initial settings transmitted to the throttle 8 and the fuel injectors are intended to supply the combustion chamber with a lean air-fuel mixture, preferably with an air factor λ>1.05. In this case, the throttle 8 is initially set to be sufficiently open to ensure that the engine operates at a high load. A typical throttle angle for this purpose is 30°, although different angles are possible depending on the valve properties. Depending on the continuously monitored values of the engine speed, the CPU 13 regulates the composition of the air-fuel mixture. If no misfiring of the engine is detected and if the engine speed is within a predetermined range, the CPU 13 transmits signals to the fuel injectors to adjust the amount of fuel to reduce the difference between the target and the actual air/fuel ratio.

The arrangement according to the invention also allows for adjustment of the amount of injected fuel for each consecutive cylinder during the start-up operation.

Figure 4:
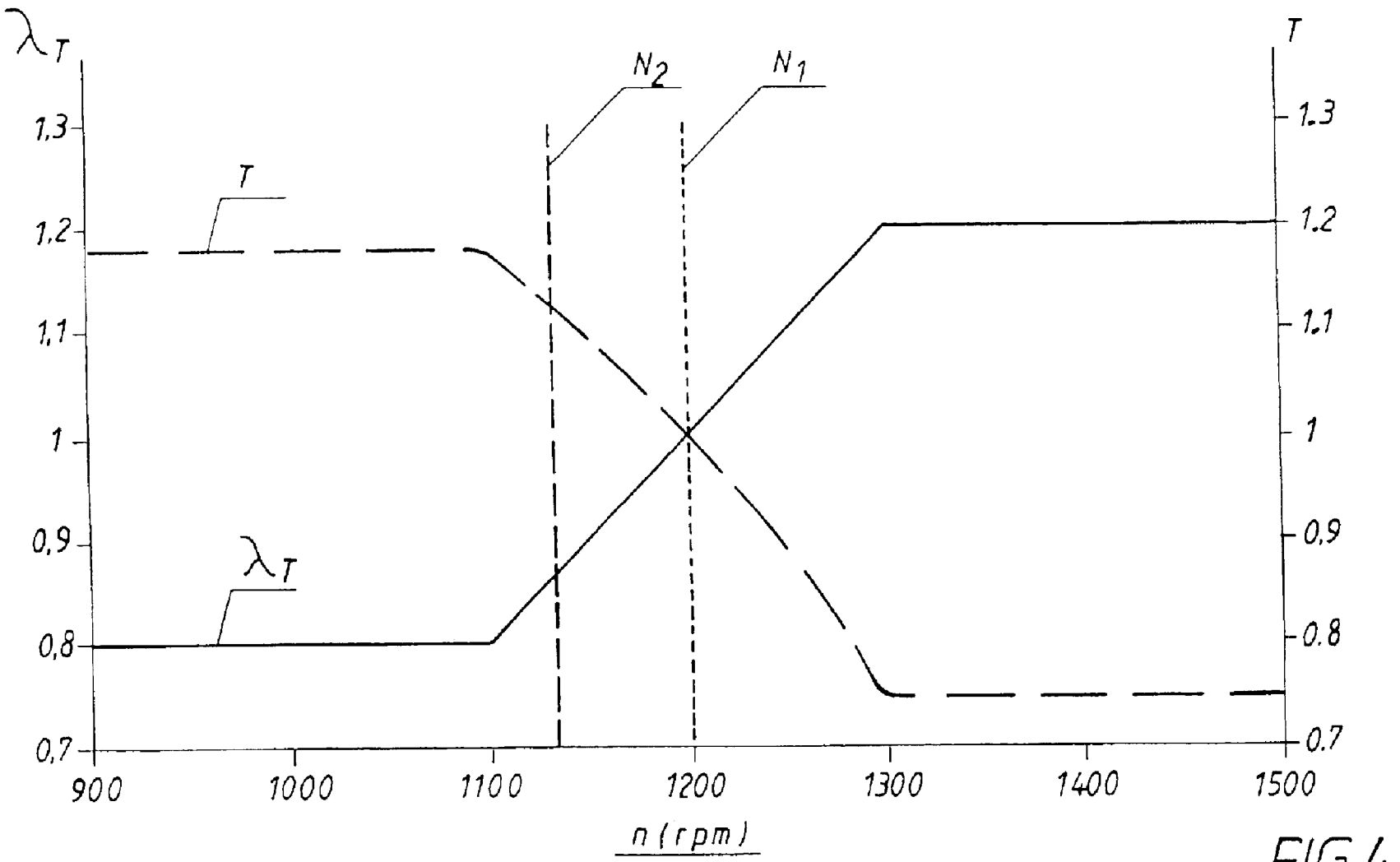
FIG. 4 shows the target air factor, $\lambda_T$, and the relative torque plotted with respect to idle speed.

In this way, the CPU 13 adjusts the air factor, λ, to a predetermined value when the engine is started. The value of the actual air factor, $\lambda_A$, is determined by the lean start strategy used for each type of engine and is usually selected within the range of $1.02 > \lambda_A > 1.5$. In this particular case, the selected value of $\lambda_A$ is 1.05 as indicated in FIG. 4.

An example of a mapping for the CPU is given below:

| Fuel factor | 1.2 | 1.2 | 1.2 | 1.2 | 1.1 | 1.0 | 0.9 | 0.9 |
|---|---|---|---|---|---|---|---|---|
| Speed (rpm) | 700 | 800 | 900 | 1000 | 1100 | 1200 | 1300 | 1400 |

The fuel/air ratio is the amount of fuel in comparison with the amount of air. This is the reciprocal of the air/fuel ratio that is described by the air factor, $\lambda$. The fuel factor is the supplied amount of fuel over the theoretically required amount of fuel. As the CPU 13 is arranged to control the amount of injected fuel, it usually operates with the fuel factor instead of the air factor.

During the cold start operation the engine idle speed is allowed to vary as a function of the difference between the target and the actual air/fuel ratio. The CPU 13 does not take any action to correct variations in the idle speed as long as it remains within a predetermined range.

FIG. 4 shows the target air factor $\lambda_T$ and the relative torque plotted with respect to different idle speeds for an internal combustion engine. The relative torque is indicated as having relative value of value T=1 at a nominal idle speed $N_1$, as defined below. The values of the target air factor, $\lambda_T$, is programmed as a map containing the corresponding fuel factors in the CPU 13. The actual, or target combustion air factor, $\lambda_A$, is set to be substantially constant at $\lambda_A \approx 1.05$. At the nominal idle speed of the engine $\lambda_A = \lambda_T$. From FIG. 4, when the target air factor, $\lambda_T$, is increased, the output torque of the engine is decreased. For this particular example, the engine has a nominal operating line at an idle speed $N_1$ of 1200 rpm at an actual air factor $\lambda_A = 1.05$. To avoid problems with drivability when a low volatility fuel is introduced, the example shows how the operating line is adjusted to an idle speed $N_2$ of just under 1150 rpm with a corresponding target air factor of $\lambda_T \approx 0.85$.

However, the enrichment of the target air factor to $\lambda_T \sim 0.85$ will cause an enleanment of 20% of the actual air factor (to $\lambda_A \approx 1.1$). The reason for this is that the CPU 13 detects a reduction in engine speed and enriches the air/fuel ratio to compensate. The reduction in engine speed causes a temporarily increased pressure in the intake conduit, while a part of the extra fuel injected settles on the wall of the intake conduit. When the engine is started from cold, as much as 20% of the injected fuel may collect or condense on the wall of an intake pipe in the manifold 6. The latter effect is one reason why the enriched target air factor, $\lambda_T$, still gives a lean actual air factor $\lambda_A$ for the air-fuel mixture in the combustion chamber. As the engine warms up, the excess fuel in the intake conduit will evaporate and be drawn into the combustion chamber. All the above factors must be taken into account when programming the fuel factor map in the CPU 13, to achieve the correct actual air factor. When the system has settled at the new operating line, the actual air factor is maintained at $\lambda_A \approx 1.05$. As can be seen from FIG. 4, the adjustment also causes the relative torque T to be increased by 10% from T=1 to T=1.1.

The arrangement according to the example adjusts the air/fuel ratio towards a target air factor, $\lambda_T$, that givse an actual air factor in the range $1.02 < \lambda_A < 1.2$, preferably at or near $\lambda_A = 1.05$ during a cold start of the engine. As can be seen from FIG. 4 this results in a nominal idle speed of 1200 rpm. The resulting idle speed is slightly higher than the normal idle speed, but the increase in fuel consumption is easily offset against the combined effect of lower emissions of NO, CO and $CO_2$ resulting from the lean start strategy and the reduced time to light-off for the converter 10.

Using this calibration the engine is allowed to run at a slightly lower idle speed, but with substantially the same air/fuel ratio, when a low volatility fuel is used. The initial air/fuel ratio settings and the subsequent calibration are performed using a mapping stored in the CPU 13. The CPU 13 automatically sets the desired air/fuel ratio after start-up and compensates the idle speed when changes in fuel volatility as well as performs corrections when variations in the idle speed occur. The above example relates to a case when a fuel property such as volatility decreases, but the method will of course also correct the settings of the engine if said fuel property returns to normal or improves above normal value. In the latter case a target air factor of $\lambda_T > 1.1$ may cause drivability problems due to the reduced available torque. Hence the CPU map must be programmed to handle such cases. The aim of the invention is, as stated above, to maintain the actual air factor, $\lambda_A$, at a substantially constant value of $1.02 < \lambda_A < 1.2$, preferably at or near $\lambda_A = 1.05$. Hence, if the quality of the fuel improves, the engine runs at a slightly higher speed but with a with substantially the same air/fuel ratio.

The above lean start strategy is interrupted either when the catalytic converter 10 reaches its operating temperature or when the throttle 8 is operated by the driver. In the latter case, the strategy can be set to resume if the engine speed returns to idle speed before the catalytic converter 10 is operational.

Obviously, the lean start strategy is also interrupted if problems with engine stability are detected. For reasons of drivability, some operating conditions may require a rich air-fuel mixture or adjustment of the throttle 8 and/or the ignition timing.

While the best mode for carrying out the invention has been described, those familiar with the art to which this invention relates will recognize various alternative designs and embodiments for practicing the invention as defined by the following claims.

We claim:

1. A method for controlling an internal combustion engine during a cold start operation, comprising:

supplying the engine with an air-fuel mixture having a substantially constant, lean actual air/fuel ratio when the engine is started; and allowing engine idle speed to vary as a function of the difference between a target air/fuel ratio and said actual air/fuel ratio.

2. The method of claim 1, further comprising: varying the target air/fuel ratio to control said engine idle speed.

3. The method of claim 2, further comprising: calibrating said target air-fuel ratio to provide a nominal idle speed during cold start.

4. The method of claim 3 wherein said nominal idle speed ($N_1$) during a cold start is higher than a predetermined nominal idle speed during normal operation of the engine.

5. The method of claim 3 wherein said calibration allows the nominal idle speed to vary as a function of fuel volatility, while maintaining said actual air/fuel ratio substantially constant.

6. The method of claim 5 wherein the calibration allows the nominal idle speed to be reduced if a fuel with lower volatility is used.

7. The method of claim 3 wherein a throttle in an air intake conduit is kept at a substantially fixed opening angle during the calibration.

8. The method of claim 1 wherein an actual air factor ($\lambda_A$) is within a range of $1.02 < \lambda_A < 1.2$ during cold start idling.

9. An internal combustion engine having an air intake conduit and a throttle arranged to supply induction air to at least one combustion chamber, at least one fuel injector to supply fuel to the induction air, an outlet for exhaust gas downstream from the engine, and a central processing unit for controlling the operation of said engine wherein the engine is arranged to operate with a lean actual air/fuel ratio during a cold start of the engine and has an idle speed that varies as a function of the difference between a target air/fuel ratio and the actual air/fuel ratio.

10. The engine of claim 9 wherein the central processing unit causes the fuel injectors to vary the target air/fuel ratio of the induction air to control the idle speed of the engine.

11. The engine of claim 10 wherein the target air fuel ratio is controlled by the central processing unit to achieve a nominal idle speed.

12. The engine of claim 11 wherein the throttle in the air intake air conduit is kept at a substantially fixed opening angle during the calibration.

13. The engine of claim 11 wherein the central processing unit maintains said actual air/fuel ratio substantially constant when the nominal idle speed varies due to changes in fuel volatility.

14. The engine of claim 9 wherein the engine operates with an actual air factor ($\lambda_A$) in a range of $1.02<\lambda_A<1.2$ during cold start idle.

* * * * *